United States Patent [19]

Kawaguchi

[11] Patent Number: 4,790,462

[45] Date of Patent: Dec. 13, 1988

[54] BOOT CARRIER

[76] Inventor: Richard S. Kawaguchi, 948 Gilgalad Way, Fort Collins, Colo. 80525

[21] Appl. No.: 76,152

[22] Filed: Jul. 21, 1987

[51] Int. Cl.[4] ..... A45F 3/14

[52] U.S. Cl. ..... 224/250; 224/202; 224/917

[58] Field of Search ..... 224/917, 901, 202, 206, 224/242, 251, 257, 250; 294/150

[56] References Cited

U.S. PATENT DOCUMENTS

| | | | |
|---|---|---|---|
| 1,060,257 | 4/1913 | Humphrey . | |
| 2,672,263 | 3/1954 | Alber | 224/206 X |
| 2,679,937 | 6/1954 | Fulster . | |
| 2,904,236 | 9/1959 | Peterson | 294/150 |
| 2,915,233 | 12/1959 | Moomaw . | |
| 3,600,734 | 8/1971 | Pollinger . | |
| 3,653,565 | 4/1972 | McAusland . | |
| 3,923,222 | 12/1975 | Groves . | |
| 4,127,223 | 11/1978 | Uchin | 294/150 |
| 4,337,938 | 7/1982 | Rodriguez | 224/901 X |
| 4,450,991 | 5/1984 | Gougeon . | |
| 4,529,240 | 7/1985 | Engel | 294/150 X |
| 4,530,168 | 7/1985 | Petre | 224/202 X |
| 4,537,341 | 8/1985 | Kelly . | |
| 4,629,103 | 12/1986 | Miller . | |
| 4,637,535 | 1/1987 | Aleman . | |

FOREIGN PATENT DOCUMENTS

| | | |
|---|---|---|
| 3128920 | 10/1983 | Fed. Rep. of Germany . |
| 432359 | 3/1948 | Italy . |
| 766477 | 8/1955 | United Kingdom . |
| 1422146 | 1/1976 | United Kingdom . |

*Primary Examiner*—Henry J. Recla
*Assistant Examiner*—Robert Petrik
*Attorney, Agent, or Firm*—Dean P. Edmundson

[57] ABSTRACT

A boot carrier is described for carrying a pair of boots (e.g., ski boots, hiking boots, etc.) in a side-by-side fashion. The carrier includes (a) an elongated strap, (b) first and second snugging members, and (c) first and second sleeve members secured to the snugging members. Each end of the elongated strap passes through one of the sleeve members and is detachably fastened to one of the snugging members, forming a loop beneath each snugging member. The snugging members are adjustable, and the loops are also adjustable, so that the carrier can be adjusted to accommodate boots to various types and various sizes. If desired, the two snugging members may be detachably secured together.

12 Claims, 2 Drawing Sheets

BOOT CARRIER

FIELD OF THE INVENTION

This invention relates to carrying devices. More particularly, this invention relates to devices and techniques for carrying boots and the like.

BACKGROUND OF THE INVENTION

The carrying of ski boots, hiking boots, and the like is a cumbersome task. Typically, there are several other items which a person must carry at the same time in addition to a pair of boots. For example, when the boots are ski boots it is necessary to also carry skis and poles. When the boots are hiking boots it is usually necessary or desirable to also carry other items such as camping gear, photography equipment, clothes, food, etc.

Thus, the use of some types of boot carriers is helpful and desirable when it is necessary to carry several items. Various types of carriers have previously been described. See, for example, U.S. Pat. Nos. 4,629,103; 3,653,565; 2,679,937; 3,600,734; and 3,587,951. Other types of harnesses and carriers are described, for example, in U.S. Pat. Nos. 4,637,535; 4,537,341; 4,450,991; 3,923,222; 2,915,233; and 1,060,257; British Pat. Nos. 1,422,146 and 766,477; Italian Patent No. 432,359; and German OLS No. 3128920.

However, many of such harnesses or carriers are not designed for carrying ski boots or the like. Many of the carriers which are designed for carrying boots are intended for use only with specific types of boots. Other carriers are bulky and cannot be easily carried in a coat pocket between uses.

There has not heretofore been provided a collapsible, easy to use, boot carrier which is effective and adaptable for convenient carrying of various types of boots and various sizes of boots.

SUMMARY OF THE PRESENT INVENTION

In accordance with the present invention there is provided a boot carrier for carrying a pair of boots (e.g., ski boots, hiking boots, cowboy boots) and the like in side-by-side fashion. The boot carrier is light in weight and is collapsible so that it may be stored or carried in a coat pocket when it is not being used to carry boots.

The boot carrier comprises:

(a) an elongated strap having first and second ends;

(b) first and second snugging members, wherein each snugging member includes first and second ends, wherein the first end of the first snugging member is secured to a first ring member, wherein the second end of the first snugging member is adapted to pass through the first ring member and be fastened; wherein the first end of the second snugging member is secured to a second ring member, wherein the second end of the second snugging member is adapted to pass through the second ring member and be fastened; and (c) first and second sleeve members secured to the first and second snugging members, respectively.

The first end of the elongated strap passes through the first sleeve member and is adapted to be detachably fastened to the first snugging member in a manner such that a first loop is formed by the elongated strap beneath the first snugging member. The second end of the elongated strap passes through the second sleeve member and is adapted to be detachably fastened to the second snugging member in a manner such that a second loop is formed by the elongated strap beneath the second snugging member. One boot is adapted to be supported by the first loop and encircled by the first snugging member, and the other boot is adapted to be supported by the second loop and encircled by the second snugging member.

The snugging members are adjustable so that they can accommodate various types of boots and also various sizes of boots. The size of the loop formed by each end of the elongated strap is also adjustable.

The boot carrier is preferably made of nylon webbing or leather and can be folded so as to fit into a coat pocket when not in use. Thus, it is not necessary to rent a locker to store the carrier in, nor is it necessary to store it in a vehicle when it is not being used.

Other advantages will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
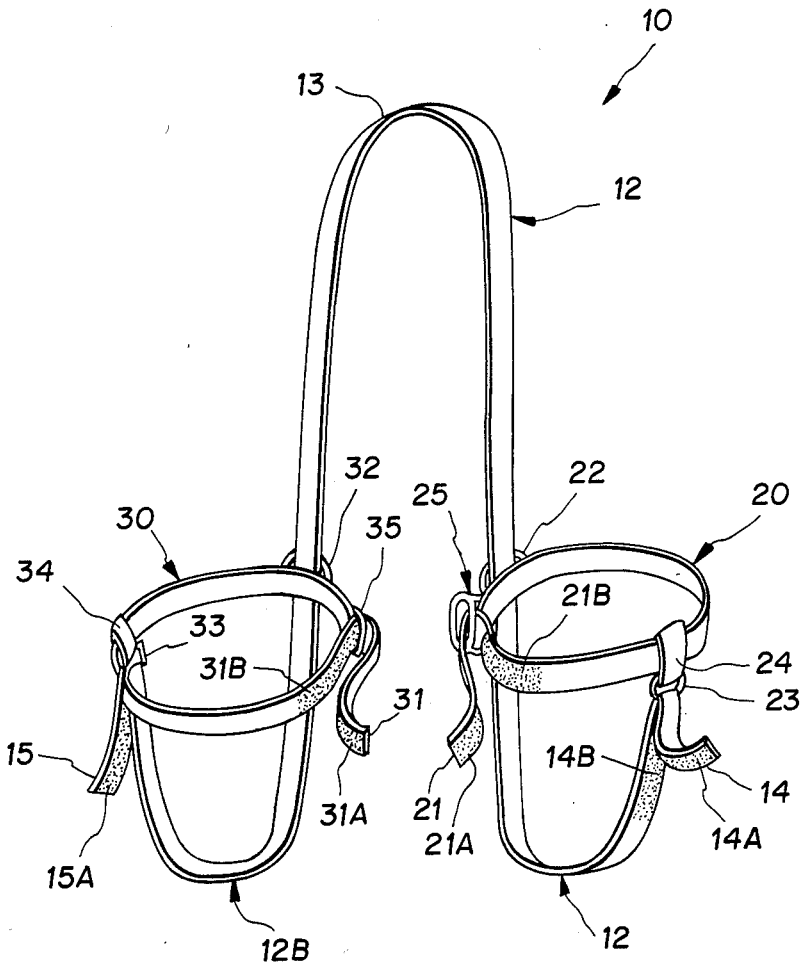
FIG. 1 is a perspective view of a preferred embodiment of boot carrier of the invention.
Figure 2:
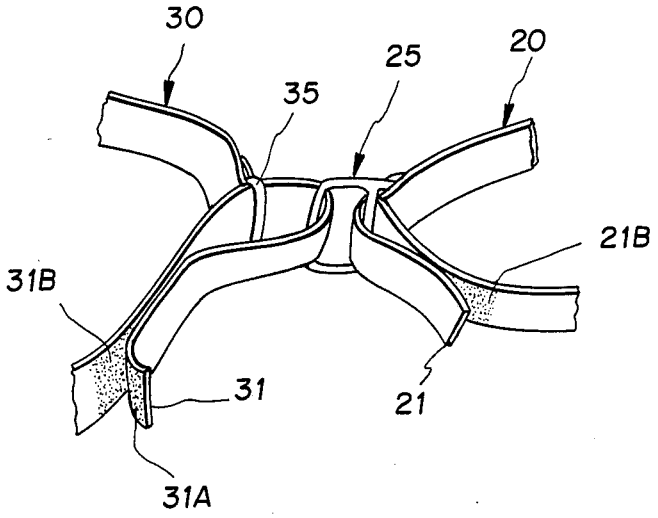

In the drawings there is illustrated a preferred embodiment of collapsible boot carrier 10 of the invention which comprises an elongated strap 12 and two snugging members 20 and 30. This boot carrier is adapted to carry a pair of boots in side-by-side fashion. The central portion 13 of strap 12 serves as a handle for grasping the carrier 10 and carrying the boots.

One end 14 of strap 12 passes through stationary sleeve or guide member 22 of snugging member 20, forms a loop 12A beneath snugging member 20, and then passes through ring 23 carried by movable sleeve member 24 on snugging member 20. Preferably the end 14 of strap 12 includes hook and loop fastener portions 14A and 14B. In this manner the end 14 is detachably secured to the snugging member. The hook and loop fasteners referred to herein are well known and are commercially available (e.g., as VELCRO brand fasteners).

Sleeve 24 can slide on the snugging member 20, and strap 12 can slide through sleeve or guide member 22, so that the snugging member and the strap can be adjusted to accommodate different types and sizes of boots. One end of the snugging member 20 is secured to ring member 25, and the other end 21 of snugging member 20 passes through ring 25 and includes hook and loop fastener portions 21A and 21B. This enables end 21 to be detachably secured at any desired position. Thus, snugging member 20 encircles a boot supported on loop 12A, and snugging member 20 may be tightened around the boot to hold it tight.

The other end 15 of strap 12 passes through sleeve or guide member 32 of snugging member 30, forms a loop 12B beneath snugging member 30, and then passes through ring 33 carried by movable sleeve member 34 on snugging member 30. Preferably the end 15 of strap 12 includes hook and loop fastener portions (one portion 15A is visible). Thus, end 15 is detachably secured to the snugging member.

Sleeve 34 can slide on the snugging member 30, and strap 12 can slide through sleeve or guide 32, so that the snugging member and the strap can be adjusted to accommodate different types and sizes of boots. One end of the snugging member 30 is secured to ring member 35, and the other end 31 of snugging member 30 passes through ring 35 and includes hook and loop fastener portions 31A and 31B. This enables end 31 to be detachably secured at any desired position. Thus, snugging member 30 encircles a boot supported on loop 12B, and snugging member 30 may be tightened around the boot to hold it tight.

If desired, end 31 of snugging member 30 may be passed through both ring 35 and ring 25 and then secured to snugging member 30 so as to detachably secure the two snugging members together. This arrangement is beneficial when the boot carrier is carried by the hand because it keeps the boots together at all times. If it is desired to support the boot carrier on the shoulder, it is preferred to not connect the snugging members together.

The material used for the elongated strap and the snugging members may vary. For example, it may be nylon webbing, canvas, plastic, leather, cloth, rope, etc. The width of the material may also vary (e.g., up to about 3 inches). Combinations of various materials may also be used. Also, the materials may be provided in various colors.

The length of the elongated strap 12 may also vary. Generally it has a length in the range of about 5 to 6 feet. The length of the strap in each snugging member may also vary but should be long enough to encircle various sizes and types of boots.

Although hook and loop fastener materials are preferred in this invention for securing the ends of the elongated strap and also the snugging members, it is possible to use other types of fasteners if desired. For example, various types of buckles or D-rings could be used, if desired.

The boot carrier of this invention is very easy to use. A boot is positioned over each loop (12A and 12B) and then the snugging member is pulled tight and secured around the upper portion of the boot. The adjustments which are possible with each end of the elongated strap and also with each snugging member enable the carrier to be used for carrying any type of size of boot (e.g., ski boots, hiking boots, after-ski boots, cowboy boots, and other types of boots or tall shoes).

It is also possible to disassemble the boot carrier, if desired, by sliding the snugging members off the elongated strap. This enables any portion of the carrier to be replaced, or cleaned, etc.

The compactness of the boot carrier also facilitates the storage or carrying the carrier in a coat pocket, for example. This avoids the need for separate storage of the carrier (e.g., at the ski slopes).

Other variants are possible without departing from the scope of the present invention.

What is claimed is:

1. A boot carrier for carrying a pair of boots in side-by-side fashion, said carrier comprising:

(a) an elongated strap having first and second ends;

(b) first and second snugging members, wherein each said snugging member comprises a flexible strap which includes first and second ends, wherein said first end of said first snugging member is secured to a first ring member, wherein said second end of said first snugging member is adapted to pass through said first ring member and be fastened; wherein said first end of said second snugging member is secured to a second ring member, wherein said second end of said second snugging member is adapted to pass through said second ring member and be fastened;

(c) first and second sleeve members secured to said first and second snugging members, respectively; wherein said first end of said elongated strap passes through said first sleeve member and is adapted to be detachably fastened to said first snugging member in a manner such that a first loop is formed by said elongated strap beneath said first snugging member; wherein said second end of said elongated strap passes through said second sleeve member and is adapted to be detachably fastened to said second snugging member in a manner such that a second loop is formed by said elongated strap beneath said second snugging member; wherein one said boot is adapted to be supported by said first loop and encircled by said first snugging member, and wherein the other said boot is adapted to be supported by said second loop and encircled by said second snugging member; wherein said first end of said second snugging member is adapted to pass through said first ring member and said second ring member in a manner such that said first and second snugging members are detachably secured together.

2. A boot carrier in accordance with claim 1, wherein a first movable sleeve member is carried by said first snugging member and a second movable sleeve member is carried by said second snugging member; wherein said first end of said elongated strap is adapted to be detachably fastened to said first movable sleeve member; and wherein said second end of said elongated strap is adapted to be detachably fastened to said second movable sleeve member.

3. A boot carrier in accordance with claim 1, wherein said first and second ends of said elongated strap each include hook and loop fasteners.

4. A boot carrier in accordance with claim 1, wherein said second end of each said snugging member includes a hook and loop fastener.

5. A boot carrier in accordance with claim 1, wherein said elongated strap comprises nylon webbing.

6. A boot carrier in accordance with claim 1, wherein said elongated strap comprises leather.

7. A boot carrier for carrying a pair of boots in side-by-side fashion, said carrier comprising:

(a) an elongated strap having first and second ends, wherein each said end includes a hook and loop fastener;

(b) first and second snugging members; wherein each said snugging members comprises a flexible strap and includes first and second ends, wherein said first end of said first snugging member is secured to a first ring member, wherein said second end of said first snugging member is adapted to pass through said first ring member and be fastened; wherein said first end of said second snugging member is secured to a second ring member, wherein said second end of said second snuggling member is adapted to pass through said second ring member and be fastened;

(c) first and second stationary sleeve members secured to said first and second snugging members, respectively;

(d) first and second movable sleeve members carried by said first and second snuggling members, respectively; wherein said first end of said elongated strap passes through said first stationary sleeve member and is adapted to be detachably fastened to said first movable sleeve member in a manner such that a first loop is formed by said elongated strap beneath said first snugging member; wherein said second end of said elongated strap passes through said second stationary sleeve member and is adapted to be detachably fastened to said second movable sleeve member in a manner such that a second loop is formed by said elongated strap beneath said second snugging member; wherein one said boot is adapted to be supported by said first loop and encircled by said first snugging member, and wherein the other said boot is adapted to be supported by said second loop and encircled by said second snugging memory; wherein said first end of said second snugging member is adapted to pass through said first ring member and said second ring member in a manner such that said first and second snugging members are detachably secured together.

8. A boot carrier in accordance with claim 7, wherein said second end of each said snugging member includes a hook and loop fastener.

9. A boot carrier in accordance with claim 7, wherein said elongates strap comprises nylon webbing.

10. A boot carrier in accordance with claim 7, wherein said elongated strap comprises leather.

11. A boot carrier for carrying a pair of boots in side-by-side fashion, said carrier comprising:

(a) an elongated strap having first and second ends;

(b) first and second snugging members; wherein each said snugging member comprises a flexible strap and includes first and second ends, wherein said first end of said first snugging member is secured to a first ring member, wherein said second end of said first snugging member includes a hook and loop fastener and is adapted to pass through said first ring member and be fastened to itself; wherein said first end of said second snugging member is secured to a second ring member, wherein said second end of said second snugging member includes a hook and loop fastener and is adapted to pass through said second ring member and be fastened to itself;

(c) first and second stationary sleeve members secured to said first and second snugging members, respectively;

(d) first and second movable sleeve members carried by said first and second snugging members, respectively; wherein said first end of said elongated strap passes through said first stationary sleeve member and is adapted to be detachably fastened to said first movable sleeve member in a manner such that a first loop is formed by said elongated strap beneath said first snuggling member; wherein said second end of said elongated strap passes through said second stationary sleeve member and is adapted to be detachably fastened to said second movable sleeve member in a manner such that a second loop is formed by said elongated strap beneath said second snugging member; wherein one said boot is adapted to be supported by said first loop and encircled by said first snugging member; wherein the other said boot is adapted to be supported by said second loop and encircled by said second snugging member; and wherein said first and second snugging members are adjustable; and wherein said first end of said second snugging member is adapted to pass through said first ring member and said second ring member in a manner such that said first and second snugging members are detachably secured together.

12. A boot carrier in accordance with claim 11, wherein said first and second ends of such elongated strap each include hook and loop fasteners.

* * * * *